US005163177A

United States Patent [19]

Komura

[11] Patent Number: 5,163,177

[45] Date of Patent: Nov. 10, 1992

[54] PROCESS OF PRODUCING INK JET RECORDING HEAD AND INK JET APPARATUS HAVING THE INK JET RECORDING HEAD

[75] Inventor: Hirokazu Komura, Yokohama, Japan

[73] Assignee: Canon Kabushiki Kaisha, Tokyo, Japan

[21] Appl. No.: 485,477

[22] Filed: Feb. 27, 1990

[30] Foreign Application Priority Data

Mar. 1, 1989 [JP] Japan ..... 1-048840

[51] Int. Cl.[5] ..... B41J 2/05

[52] U.S. Cl. ..... 346/1.1; 346/140 R; 29/890.1

[58] Field of Search ..... 346/140 R, 1.1; 156/659.1; 252/79.3; 430/256, 259; 29/890.1

[56] References Cited

U.S. PATENT DOCUMENTS

| | | | |
|---|---|---|---|
| 4,313,124 | 1/1982 | Hara | 346/140 |
| 4,345,262 | 8/1982 | Shirato et al. | 346/140 |
| 4,459,600 | 7/1984 | Sato et al. | 346/140 |
| 4,463,359 | 7/1984 | Ayata et al. | 346/1.1 |
| 4,558,333 | 12/1985 | Sugitani et al. | 346/140 |
| 4,577,202 | 3/1986 | Hara | 346/140 R |
| 4,638,337 | 1/1987 | Torpey et al. | 346/140 R |
| 4,719,478 | 1/1988 | Tachihara et al. | 346/140 R |
| 4,720,716 | 1/1988 | Ikeda et al. | 346/140 R |
| 4,723,129 | 2/1988 | Endo et al. | 346/1.1 |
| 4,740,796 | 4/1988 | Endo et al. | 346/1.1 |
| 4,936,952 | 6/1990 | Komuro | 156/643 |

FOREIGN PATENT DOCUMENTS

| | | | |
|---|---|---|---|
| 2843064 | 4/1979 | Fed. Rep. of Germany . | |
| 54-59936 | 5/1979 | Japan . | |
| 59-123670 | 7/1984 | Japan . | |
| 59-138461 | 8/1984 | Japan . | |
| 0123670 | 11/1984 | Japan | 346/140 R |

*Primary Examiner*—Benjamin R. Fuller
*Assistant Examiner*—Victor DeVito
*Attorney, Agent, or Firm*—Fitzpatrick, Cella, Harper & Scinto

[57] ABSTRACT

A process of producing an ink jet recording head of the type that has an electro-thermal converting element which forms a heating surface in the ink channel, comprises preparing a substrate having the heating surface formed thereon, forming a cover film on the heating surface so as to cover at least the heating surface, forming the ink channel on the substrate and removing the cover film through the ink channel. Disclosed also are an ink jet recording head produced by the process, and an ink jet recording apparatus incorporating the ink jet recording head.

13 Claims, 8 Drawing Sheets

PROCESS OF PRODUCING INK JET RECORDING HEAD AND INK JET APPARATUS HAVING THE INK JET RECORDING HEAD

BACKGROUND OF THE INVENTION

1. Field of the Invention

The present invention broadly relates to a liquid jet recording head in which heat energy is applied to a liquid to cause a change in the state of the liquid, including generation of a bubble so that the liquid is discharged from a discharge port to form a liquid droplet flying toward a recording surface to attach to the same, thereby recording information such as letters, pictures and so forth. More particularly, the present invention is concerned with a process of producing a liquid jet recording head of the type described, a liquid jet recording head produced by the process, and a liquid jet recording apparatus incorporating such a recording head.

2. Related Background Art

Non-impact recording processes are becoming a matter of concern and interest because these processes can reduce the noise generated during recording to a negligibly low level. Among various kinds of non-impact recording processes, a process generally referred to as an ink (liquid) recording process is very promising because this process enables high-speed recording on ordinary paper sheets without requiring additional steps such as fixing. Hitherto, various liquid jet recording processes and devices have been proposed, some of which have already been put to commercial use while others are still being developed for practical use.

Among various types of liquid jet recording processes, a process of the type disclosed in, for example, Japanese Patent Laid-Open Publication No. 54-59936 and German Patent Laid-Open Publication (DOLS) 2843064 (which correspond to U.S. Pat. No. 4,723,129) is distinguished from other liquid jet recording processes in that the droplet-forming energy, i.e., the energy for forming and projecting a liquid droplet, is heat energy applied to the liquid.

More specifically, in the representative example of the recording process disclosed in the above-mentioned publications, the liquid being supplied with heat energy exhibits a change in its state, including a drastic increase in the volume, so that a physical force is generated to cause the liquid to be discharged in the form of a droplet from a discharge port of the recording head. The droplet flies towards a recording member and attaches to the same, thereby recording information.

In particular, the liquid jet recording process disclosed in the above-mentioned documents can be used quite conveniently in so called drop-on demand recording. In addition, this process facilitates design and production of a multi-port recording head in which a multiplicity of discharge ports are arrayed at a high density in full-line manner over the entire width of a recording region of a recording member, making it possible to produce a record image of high resolution and high degree of image quality.

This type of recording process is generally referred to as a "bubble jet recording process". FIGS. 1(A) and 1(B) show, by way of example, a typical liquid jet recording head of background art employing this type of recording process. More specifically, FIG. 1A is a plan view of a substrate having heat generating portions disposed in liquid channels for a recording liquid, which is in this case an ink, and leading to discharge ports, while FIG. 1B is a sectional view of the substrate taken along the line X'—Y' of FIG. 1A.

The substrate is denoted by 101, while 102 denotes a heat generating portion (referred to also as a "heater", hereinafter) which is disposed within the walls of each ink channel leading to an associated ink discharge port and capable of applying heat energy to the ink in the ink channel thereby generating a bubble. The heater 102 has a heat-generating resistor layer 107 to which are connected lead electrodes made of aluminum (Al) for applying a predetermined voltage across the heat-generating resistor 107. The heat-generating resistor layer 107 is carried by a carrier made of silicon (Si). Thus, the heater 102 is presented by the region between the pair of electrodes 103, 104.

A first upper protective layer 108 made of $SiO_2$ covers the entire area over the lead electrodes 103, 104 and other portions. A major portion of the first upper protective layer 108 is further protected by a third upper protective layer 109 the surface of which contacts the ink. A second upper protective layer 110 covers the region where the heater 102 exists. The second upper protective layer 110 has a bubble-generating surface 112. The electrodes 103, 104 and the heat-generating resistor layer 107 in combination form an electro-thermal conversion element 111 which converts electrical energy into heat energy. In operation, when the bubble-generating surface 112 is heated by the heat generated by the heater 102, a bubble is formed in the ink contacting the bubble-generating surface 112 so that the ink is displaced and is discharged in the form of a droplet from the ink discharge port.

In the liquid jet recording head of bubble-jet type described hereinabove, a voltage is generated across the heater through the electrodes so as to cause the heater to generate heat which forms a bubble in the ink to discharge a droplet of ink from the discharge port. Thus, the generation and discharge of the ink droplet relies upon the principle of film boiling which generates a bubble. The state of the bubble-generating surface is therefore a very significant factor. Namely, stability of ink discharge is often impaired by the unstable generation of the bubble caused by such factors as the presence of minute convexities and concavities on the bubble-generating surface, i.e., the heater surface, attaching of a very thin film to the bubble-generating surface, and so forth.

Recording heads commercially produced are tested after fabrication for the purpose of confirmation of the printing quality they produce. In some cases, the rate of rejection is impractically large due to fluctuations in the printing quality according to the recording head products. Recording heads which showed inferior printing characteristics have been examined and it has been found that the unstable generation of the bubble was due to changes in the state of the bubble-generating surface or residue remaining on the bubble-generating surface. It has thus been confirmed that unstable bubble generation causes a fluctuation in the velocity or direction of the ink droplet discharged from the head, resulting in degradation of the printing quality.

A study has also been made to clarify the causes of the change in the surface state of the bubble-generating surface and the generation of residue on the bubble-generating surface, and it has been found that these are attributable to the following causes.

(1) The state of the bubble-generating surface tends to change during patterning due to a reaction between a photo-resist and the bubble-generating surface.

(2) Deposition of residue is caused by incomplete separation of the photo-resist after patterning.

(3) The state of the bubble-generating surface tends to change as a result of a reaction between the bubble-generating surface and a photosensitive resin which is used in a process for forming liquid channels leading to the discharge ports.

(4) The photosensitive resin mentioned above tends to remain as residue on the bubble-generating surface due to incomplete removal.

(5) The bubble-generating surface tends to be contaminated by various resins used in packaging or the mounting process such as a flux resin and sealing resin which remain as residue on the bubble-generating surface.

It might be possible to overcome the aforementioned problem by eliminating causes (1) to (5) mentioned above. Such a measure, however, is impractical and extremely difficult to conduct due to the necessity for changing the materials used for producing the head, as well as alteration of production processes. In addition, production cost is raised due to the use of special materials.

SUMMARY OF THE INVENTION

Accordingly, an object of the present invention is to provide a process of producing a liquid jet recording head in which degradation of the bubble-generating surface due to contamination and deposition of residue are eliminated by comparatively inexpensive means so as to improve the liquid discharging stability to reduce fluctuation in the discharge characteristics and thus reduce the rate of rejection of the products, thereby overcoming the abovedescribed problems of the prior art.

To this end, according to one aspect of the present invention, there is provided a process of producing an ink jet recording head of the type which has an electrothermal conversion element including a heat-generating resistor layer and a pair of electrodes connected to the heat-generating resistor layer, the portion of the heat-generating resistor layer between the pair of electrodes providing a heat-generating portion, an ink channel corresponding to said heat-generating portion and communicating with an ink discharge port, a portion of the wall of the ink channel corresponding to the heat-generating portion providing a heating surface which directly supplies the ink with heat energy for discharging the ink. The method comprises the steps of preparing a substrate having the heating surface formed thereon, forming a cover film on the heating surface so as to cover at least the heating surface, forming the ink channel on the substrate, and removing the cover film through the ink channel.

Another object of the present invention is to provide a liquid jet recording head which is produced in accordance with the process of the invention, as well as a liquid jet recording apparatus incorporating such a recording head.

These and other objects, features and advantages of the present invention will become clear from the following description of the preferred embodiments when the same is read in conjunction with the accompanying drawings.

According to one aspect of the process of the present invention, after formation of a bubble-generating surface, a cover film is formed so as to cover the formed bubble-generating surface and, when the main part of the recording head is obtained after formation of a liquid channel, the cover film is removed through the liquid channel. It is therefore possible to prevent any change in the state of the bubble-generating surface and deposition of residue to the same during production of the recording head. Consequently, any fluctuation in the recording liquid discharge characteristics after completion of the recording head can be reduced significantly to improve the rate of production of products which are to be accepted, i.e., to reduce the rate of rejection, in the examination which is conducted after the production.

More specifically, according to an embodiment of the present invention, the bubble-generating surface is kept covered by the cover film until the final step of the production process, so that contaminants generated during production are deposited only on the cover film and do not reach the bubble-generating surface which is the critical part for bubble generation. The cover film also isolates the bubble-generating surface from substances which may otherwise react with the bubble-generating surface to change the state of this surface. The cover film is then removed after completion of fabrication of major portions of the recording head. Consequently, a bubble-generating surface of good quality can be consistently obtained in the final product, so that fluctuations in the bubble-generating characteristics are suppressed, thus providing consistent and excellent printing (recording) quality, whereby the rate of rejection of the products in the test after production can remarkably be reduced.

It will be clear to those skilled in the art that the cover film is preferably of the type which does not cause any problem in subsequent steps of the production process and which can easily be removed after completion of fabrication of the main part of the recording head. The thickness of the cover film should be determined so as not to cause any undesirable effect on other portions of the recording head during the production process. It is not essential that the cover film cover only the bubble-generating surface. Namely, the cover film may be sized to cover not only the bubble-generating surface but also regions around the bubble-generating surface, provided that the portion of the cover film on the bubble-generating surface can be removed without fail after the production of the recording head.

DESCRIPTION OF THE PREFERRED EMBODIMENTS

Preferred embodiments of the present invention will be described in detail with reference to the drawings.

Figure 1:
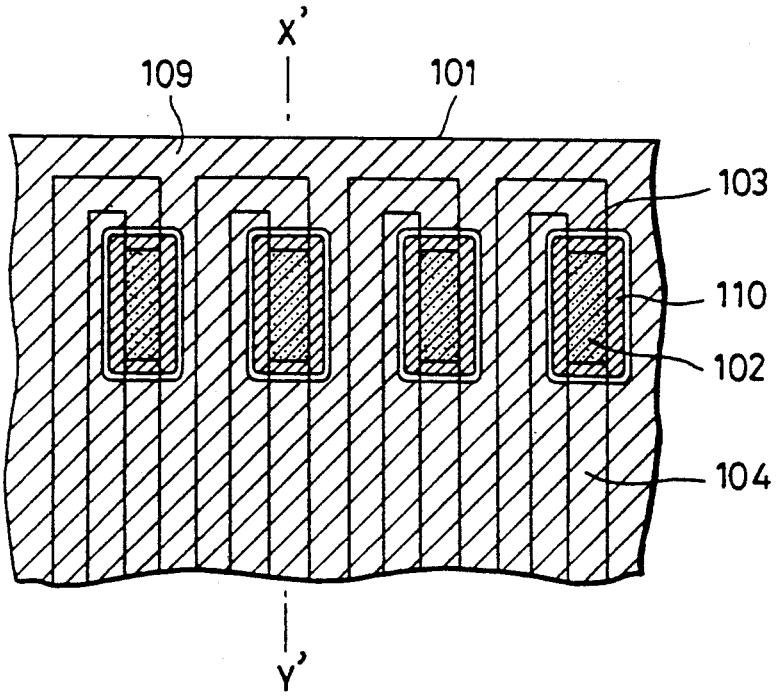
FIGS. 1A and 1B are a plan view and a sectional view, respectively, of a substrate of a liquid jet recording head of a background art.
Figure 1:
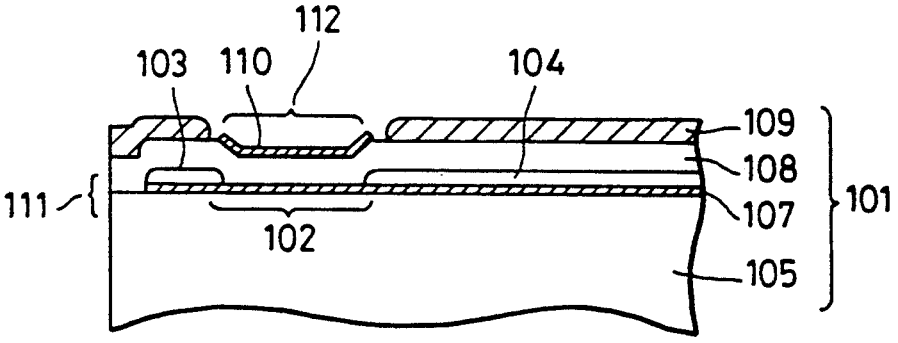
Figure 2:
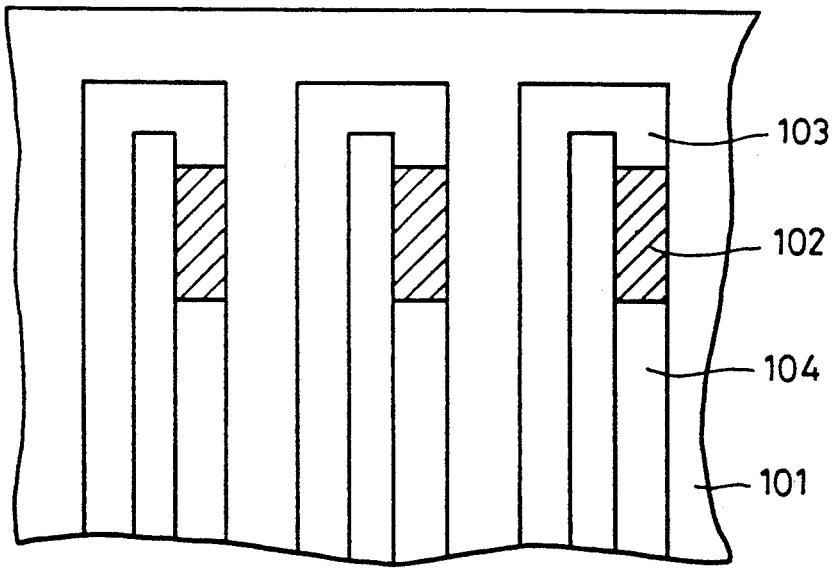
FIG. 2 is a plan view of a liquid jet recording head during a step in the production process embodying the present invention.
Figure 3:
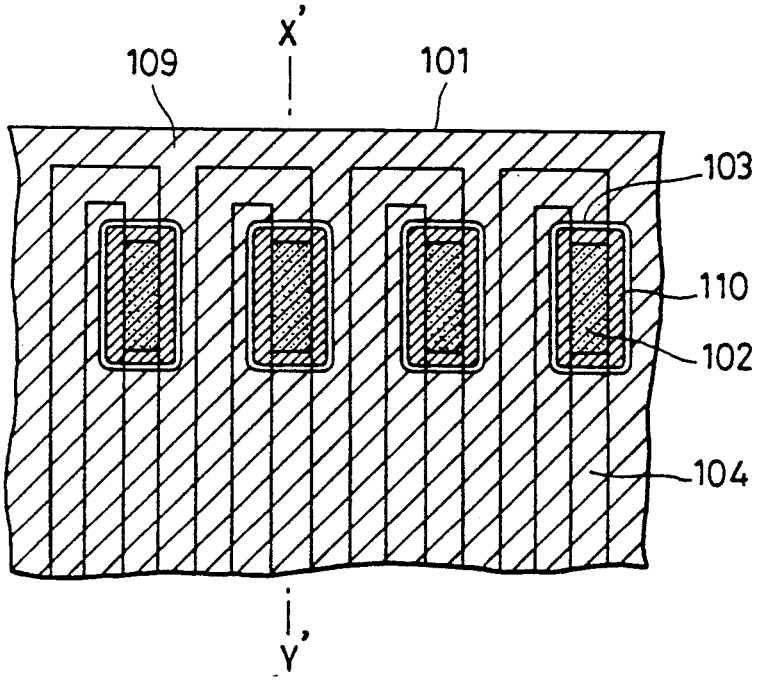
FIG. 3A is a plan view of a liquid jet recording head during another step in the production process embodying the present invention.
FIG. 3B is a sectional view taken along the line X'—Y' of FIG. 3A.
Figure 3:
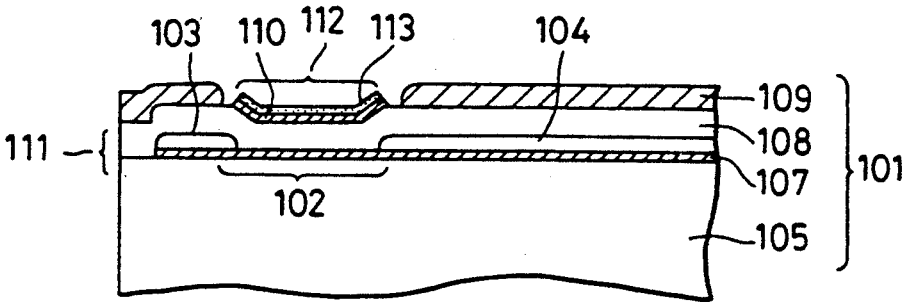

FIGS. 2, 3A, 3B and 6A to 6D show an embodiment of the process of the invention for producing a liquid jet recording head, in particular the substrate of such a head in different steps of production. FIGS. 2 and 3A are top plan views of the substrate, while FIG. 3B is a sectional view taken along the line X'—Y' of FIG. 3A which shows, in particular, a cover film 113. FIGS. 6A to 6D show the substrate in sectional views. In these Figures, the same reference numerals are used to denote the same parts or members of the background art described before in connection with FIGS. 1A and 1B.

Referring to these Figures, a heat-generating resistor layer 107 of $HfB_2$ (hafnium boride) is formed by RF (radio wave frequency) sputtering on a carrier 105 made of silicon (Si) to a thickness of about 1000 Å. The carrier 105, however, may be made of a suitable other material such as glass. Subsequently, an aluminum (Al) layer is formed on the heat-generating resistor layer 107 by evaporation deposition to a thickness of about 5000 Å so as to form electrodes 103 and 104. Then, a photolithographic process is conducted with a photo-mask so as to form a rectangular heat-generating portion, i.e., heater, denoted by 102, as will be seen from FIG. 2.

Then, a first upper protective layer 108 of $SiO_2$ (silicon oxide) is formed by RF sputtering to a thickness of about 9000 Å over the entire area of the substrate as shown in FIGS. 6A–6D, followed by formation of a second upper protective layer 110 of Ta (tantalum) of about 5000 Å. The surface of the second upper protection layer of Ta provides a bubble-generating surface (referred to also as "heating surface"). Then, a cover film 113 of Ti (titanium) is formed to a thickness of 500 Å so as to cover the second upper protective layer 110 of Ta.

Figure 6:
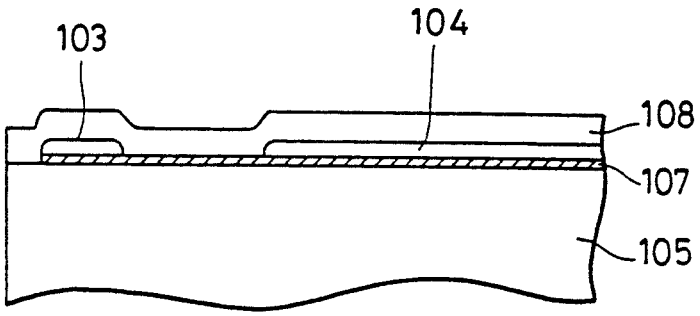
FIGS. 6A to 6D are sectional views of a substrate of an ink jet head during different steps in the production process embodying the present invention.
Figure 6:
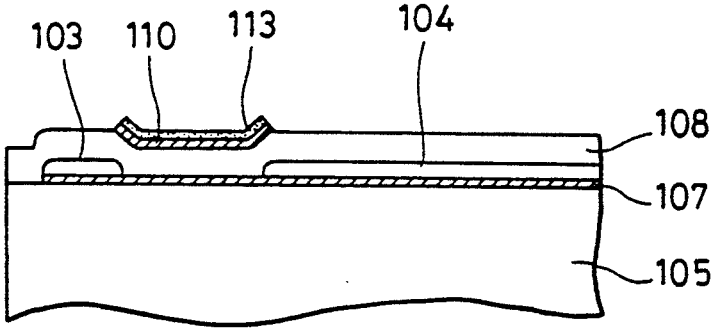
Figure 6:
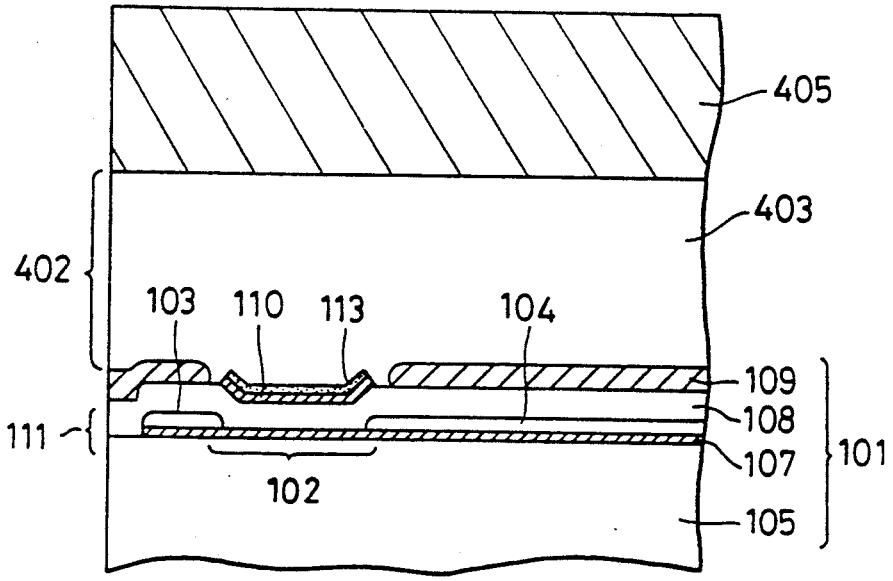
Figure 6:
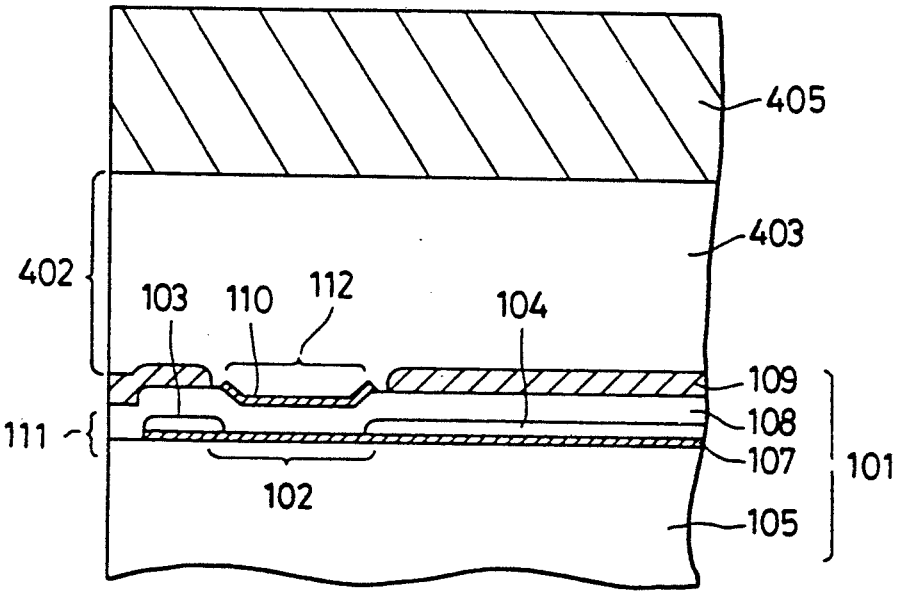

Subsequently, a photolithographic patterning operation is conducted so as to leave the protective layer 110 of Ta and the cover film 113 of Ti only in the region on and around the heater 102, as shown in FIG. 6B. At the same time, a photolithographic patterning operation is conducted on the first upper protective layer 108 of $SiO_2$ so as to form through-holes only in the lead electrodes 103 and 104.

If it is assumed here that the cover film 113 of Ti is absent as in the case of the background art, the following problems are caused in the course of the photolithographic process. The photolithographic process is executed by applying a photo-resist to the bubble generating surface 112 of the Ta layer. After the patterning, the photo-resist is separated. Thus, there is a risk that the surface of the Ta layer will deteriorate due to a reaction with the photo-resist during the patterning. In addition, if the photo-resist cannot be removed completely, a portion of the photo-resist undesirably remains as a residue on the bubble-generating surface 112 of the Ta layer. These problems, however, can be eliminated by virtue of the provision of the cover film of Ti on the bubble-generating surface 112 of the Ta layer. Namely, the photo-resist reacts only with the layer of Ti which forms the cover layer 113 so that no reaction takes place between the bubble-generating surface 112 of Ta and the photo-resist. In addition, any residue remains only on the cover film 113 of Ti, without being deposited on the bubble generating surface 112. Thus, the photo-resist does not produce any undesirable effects on the bubble-generating surface 112 of Ta.

Subsequently, an agent such as that produced and sold by Toray Inc. under a trademark of PHOTONEATH is applied and a window is formed in the region of the heater 102 as shown in FIG. 3B, while forming through-holes in the same positions as those of the above-mentioned through-holes formed in the $SiO_2$ layer 108.

Absence of the Ti cover film 113 also would cause a problem in this step. Namely, the agent PHOTONEATH would be undesirably applied to the bubble-generating surface 112 of Ta, causing a risk that the layer of Ta will react with the PHOTONEATH. This problem, however, is overcome by the present invention which employs the Ti cover film 113 on the bubble-generating surface 112 of Ta. Namely, the PHOTONEATH can react only with Ti of the cover film 113 and does not affect at all the layer of Ta forming the bubble-generating surface 112.

The electro-thermal conversion element used in the present invention includes a heat-generating resistor layer, a pair of electrodes connected to the resistor layer and a protective layer or layers which are provided as necessitated to protect the resistor layer and the electrodes.

Then, an Al layer (not shown) for forming the second electrode layer is formed by evaporation, followed by a patterning process conducted in such a manner as to leave only the portion of the Al layer corresponding to the common electrode. Subsequently, a channel leading to a discharge port is formed on the substrate 101.

The liquid channel leading to the discharge port can be formed by, for example, a method which employs a photosensitive resin. In this method, the photosensitive resin is used as the material for forming the walls of the liquid channel. More specifically, a layer of the photosensitive resin is provided over the entire area of the substrate 101 by, for example, a laminating technique and then the portion which is to form the channel recess is removed by a photolithographic process. If the cover film 113 of Ti were absent, the photosensitive resin would be allowed to directly contact the layer of Ta which forms the bubble-generating surface 112, causing a risk that the bubble-generating surface will be degraded due to a reaction with the photosensitive resin. In addition, a portion of the photosensitive resin layer may remain as a residue. According to the invention, however, these problems are eliminated by virtue of provision of the cover film 113 of Ti formed on the layer of Ta which forms the bubble-generating surface 112. Namely, the reaction, if any, takes place only on the surface of the cover film 113 of Ti. Similarly, any residue remains only on the surface of the cover film 113 of Ti.

A mounting process is then commenced after formation of the liquid channel leading to the discharge port (orifice).

Although various mounting methods are available, a method known as the flip-chip bonding method is becoming popular in which integrated circuits (ICs) are mounted using a solder. This method employs a soldering flux which has to be removed after the mounting of the IC. If the cover film 113 of Ti is absent, the flux would enter the liquid channel and contaminate the bubble-generating surface 112. According to the invention, however, there is no risk of contamination of the bubble-generating surface because the flux contaminates only the surface of the cover film 113 made of Ti.

Figure 4:
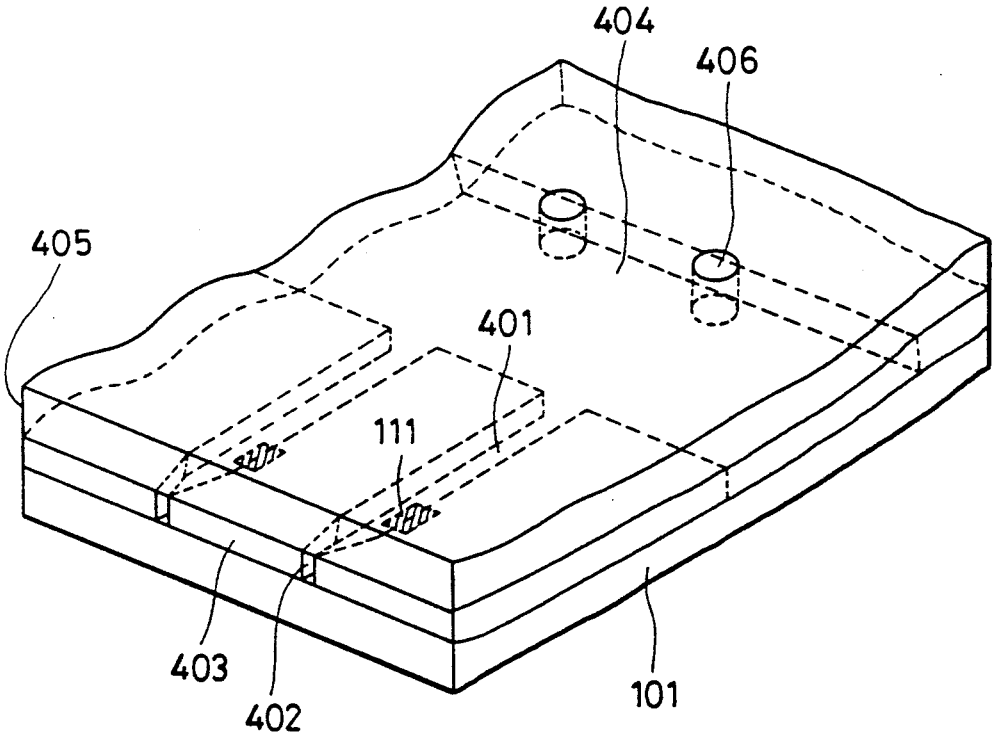
FIG. 4 is a perspective view of an essential portion of the recording head embodying the present invention.

A recording head as shown in FIGS. 4 and 6C is thus completed. This recording head has a liquid channel 401, a discharge port or orifice 402, a layer 403 formed of photosensitive resin defining the liquid channels 401 (i.e., the walls of ink channels), a common liquid chamber 404 communicating with a plurality of liquid channels 401, a top plate (referred to also as "cover member") 405 and an ink supply port 406 which is formed in the top plate 405 in communication with the common liquid chamber 404. In this specification, a term "ink channel" is used to include both the liquid channel 401 and the common liquid chamber 404.

Subsequently, an etchant to Ti, which is in this case a 11% solution of hydrofluoric acid, is supplied into the liquid channel 401 of the recording head. In consequence, the cover film 113 made of Ti is etched and removed while other portions remain unetched, so that the bubble-generating surface 112 of Ta is exposed as shown in FIG. 6D. The etching can be effected satisfactorily regardless of any slight denaturation of the surface of the cover film 113 of Ti. Any residue remaining on the cover film 113 of Ti does not substantially hamper the etching unless the cover film 113 is wholly covered by the residue, because the etchant can spread and permeate to completely etch and remove the cover film 113 of Ti.

Thus, the bubble-generating surface 112 of Ta is exposed only after the completion of the whole production process, so a to initialize the recording head and make it ready for use. Consequently, the recording heads thus produced exhibit stable and uniform discharge characteristics and, hence, superior printing quality in tests conducted subsequent to production.

According to the described method, Ti may remain in the vicinity of the heat-generating portion 102 immediately under the wall of the liquid channel 401 leading to the orifice 402. This, however, did not substantially affect the affinity between the wall forming material and the substrate. If the portion of the Ti remaining in the above-mentioned region has any possibility of producing an undesirable effect, such an effect can be avoided by conducting the patterning process after the formation of the Ti film in such a manner that Ti remains exactly only on the portion corresponding to the liquid channel above the bubble-generating surface.

Figure 7:
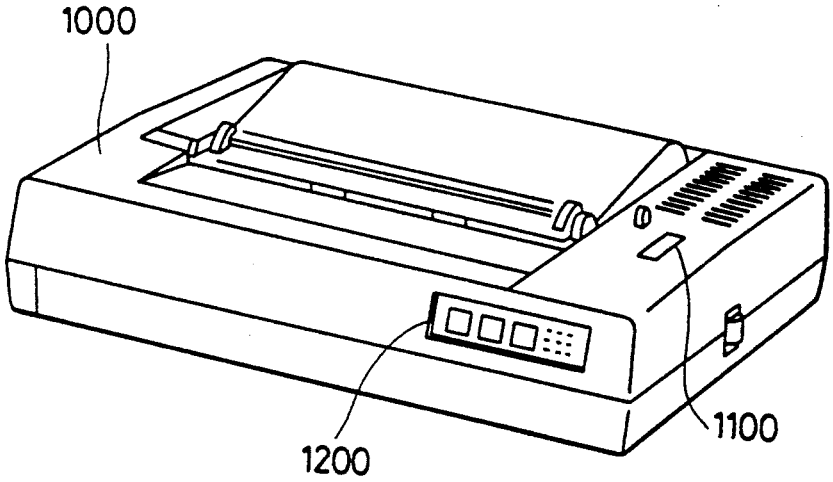
FIG. 7 is a perspective view of an ink jet recording apparatus incorporating an ink jet recording head produced in accordance with the production process of the present invention.

FIG. 7 is a perspective view of an ink jet recording apparatus incorporating an ink jet head produced in accordance with the process of the invention. This ink jet recording apparatus has a main part 1000, a power switch 1100 and a control panel 1200.

Although Ti is used in the described embodiment as the material of the cover film which covers the bubble-generating surface, this is only illustrative and Ti maybe substituted by other suitable metals, although Ti is used most suitably. Examples of such metals are copper (Cu), aluminum (AL), nickel (Ni) and chromium (Cr). Even organic materials can be used as the material of the cover film formed on the bubble-generating surface, provided that they have high stability against reactions. Examples of such organic materials arc photosensitive resins such as a positive resist material OFPR (the commercial name of such material produced by TOK Company Ltd.) and a negative resist material OMR 80 (the commercial name of such a material produced by TOK Company Ltd.).

Preferably, the thickness of the cover film covering the bubble-generating surface ranges between 500 Å and 2 μm, more preferably between 1000 Å and 1 μm.

Figure 5:
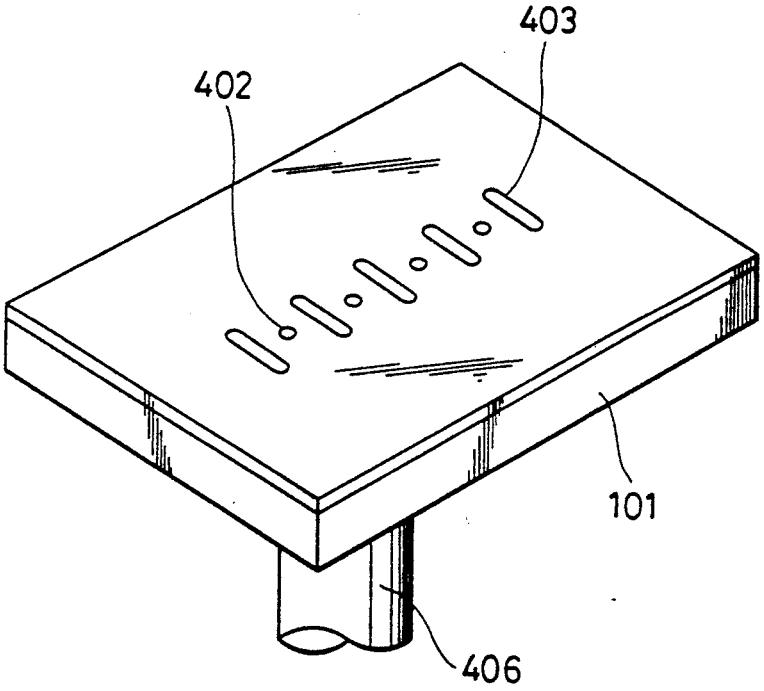
FIG. 5 is a perspective view of another embodiment of the recording head in accordance with the present invention.

In the described embodiment, the recording head is designed to discharge the recording liquid in a direction parallel to the plane of the heater. The invention, however, can be applied also to a recording head of the type in which, as shown in FIG. 5, the recording liquid is discharged substantially perpendicular to the heater.

In the embodiment described above, the bubble-generating surface is presented by an upper protective layer covering the heater. This, however, is only illustrative and the invention can be applied to recording heads devoid of such an upper protective layer, for example, recording heads in which the heater material is exposed.

The present invention brings about excellent effects particularly when used in a recording head or recording device of the bubble jet type among various ink jet recording systems.

As to its representative construction and principle, for example, one practiced by use of the basic principle disclosed in, for example, U.S. Pat. Nos. 4,723,129 and 4,740,796 is preferred. This system is applicable to either the so-called on-demand type or the continuous type. The on-demand type is particularly effective because, by applying at least one driving signal (which gives rapid temperature elevation exceeding nucleate boiling) corresponding to the recording information on an electro-thermal conversion element arranged corresponding to a liquid channel holding the liquid (ink), heat energy is generated at the electro thermal conversion elements to effect film boiling at the heat acting surface of the recording head. Consequently, the bubbles within the liquid (ink) can be formed to correspond to the driving signals. By discharging the liquid (ink) through the discharge port by growth and contraction of the bubble, at least one droplet is formed. By making the driving signal into pulses, growth and contraction of the bubble can be effected instantly and adequately to accomplish more preferable discharging of the liquid (ink) particularly excellent in response characteristic. As the driving signals in the form of pulses, those as disclosed in U.S. Pat. Nos. 4,463,359 and 4,345,262 are suitably used. Further, excellent recording can be performed by employment of the condition described in U.S. Pat. No. 4,313,124 which concerns the temperature elevation rate of the abovementioned heat acting surface.

As the construction of the recording head, in addition to the combinations of the discharge ports or orifices, liquid channels and electro-thermal conversion elements (linear or right-angle liquid channels) as disclosed in the above-mentioned documents construction by use of U.S. Pat. Nos. 4,558,333 and 4,459,600, disclosing the construction having the heat acting portion arranged in a particular region of the liquid channel is also included in the present invention. In addition, the present invention can also be effectively carried out with the construction disclosed in Japanese Patent Laid-Open Publication No. 59-123670 which discloses the construction using a slit common to a plurality of electro-thermal conversion elements as the discharging portion or Japanese Patent Laid-Open Publication No. 59-138461 (such as opening 403A in FIG. 5) which discloses the construction having an opening for absorbing pressure waves of heat energy corresponding to the discharging portion.

Further, as a recording head of the full line type having a length corresponding to the maximum width of the recording medium which can be recorded by the recording device, either the construction which satisfies its length by combination of a plurality of recording heads as disclosed in the above-mentioned documents or the construction as one recording head integrally formed, may be used, and the present invention can exhibit the effects as described above further effectively.

In addition, the present invention is effective for a recording head of the freely exchangeable tip type which enables electrical connection to the main device or supply of ink from the main device by mounting the head on the main device, or a recording head of the cartridge type provided integrally on the recording head itself.

Also, addition of a restoration means for the recording head, a preliminary auxiliary means, etc. provided as the construction of the recording device of the present invention is preferable, because the effect of the present invention can be further stabilized. Specific examples of these may include, for the recording head, capping means, cleaning means, pressurization or aspiration means, electro thermal conversion elements or other heating elements or preliminary heating means according to a combination of these, and it is also effective for performing stable recording to perform a preliminary mode which performs discharging separate from recording.

Further, as the recording mode of the recording device, the present invention is extremely effective for not only a recording mode only for a primary stream color such as black etc., but also a device equipped with at least one of plural different colors for full color recording by color mixing, whether the recording head is integrally constructed or constructed in the form of a combination of a plurality of recording head units.

As has been described, the present invention provides a process of producing a liquid jet recording head in which a cover film is formed following the formation of a bubble-generating surface so as to cover the formed bubble-generating surface. After completion of fabrication of the main part of the recording head with a liquid channel formed therein, the cover film is removed through the liquid channel. Consequently, problems such as contamination and denaturation of the bubble-generating surface and deposition of residue during production are eliminated so as to improve discharge stability. Thus, the invention remarkably reduces fluctuation in discharge characteristics and, hence, in the rate of rejection of the products in the printing test to which the recording head products are subjected after the production process.

Although the invention has been described through specific terms, it is to be understood that the described embodiments are only illustrative and various changes and modifications may be imparted thereto without departing from the scope of the invention which is limited solely by the appended claims.

What is claimed is:

1. A process of producing an ink jet recording head which has an electro-thermal converting element including a heat-generating resistor layer and a pair of electrodes connected to said heat-generating resistor layer, a portion of said heat-generating resistor layer between said pair of electrodes providing a heat-generating portion, and an ink channel corresponding to said heat-generating portion and communicating with an ink discharge port, a portion of a wall of said ink channel corresponding to said heat-generating portion for providing a heating surface which supplies ink with heat energy for discharging ink from said orifice, said process comprising the steps of:

preparing a substrate having heating surface formed thereon;

forming a cover film on said heating surface so as to cover at least said heating surface;

forming said ink channel on said substrate; and removing said cover film through said ink channel.

2. A process according to claim 1, wherein said cover film is made of titanium.

3. A process according to claim 1, wherein said cover film is made of at least one selected from a group consisting of copper, aluminum, nickel and chromium.

4. A process according to claim 1, wherein said cover film is made of a photosensitive resin.

5. A process according to claim 1, wherein said cover film has a thickness ranging between 500 Å and 2 μm.

6. A process according to claim 1, wherein said cover film has a thickness ranging between 1000 Å and 1 μm.

7. A process according to claim 1, wherein said electro-thermal converting element has a protective layer formed on said heat-generating resistor layer for providing said heating surface.

8. A process according to claim 7, wherein said protective layer includes a layer of titanium which forms, said heating surface.

9. A process according to claim 1, wherein said heating surface is provided by the surface of said heat-generating resistor layer.

10. A process according to claim 1, wherein said step of forming said ink channel on said substrate includes the steps of:

forming opposing walls of said ink channel using a layer of photosensitive resin; and joining a cover member to said layer so as to form said ink channel.

11. A process according to claim 1, wherein said step of removing said cover film includes introducing an etchant into said ink channel to etch and remove said cover film.

12. A process according to claim 11, wherein said cover film is titanium and said etchant is a solution of hydrofluoric acid.

13. A process of producing an ink jet recording apparatus which includes a power switch having on and off portions for controlling power to said apparatus; and an ink jet recording head comprising an electro-thermal converting element including a heat-generating resistor layer and a pair of electrodes connected to said heat-generating resistor layer, a portion of said heat-generating resistor layer between said pair of electrodes providing a heat-generating portion, and an ink channel corresponding to said heat-generating portion and communicating with an ink discharge port, a portion of a wall of said ink channel corresponding to said heat-generating portion for providing a heating surface which supplies ink with heat energy for discharging ink from said orifice, said process comprising the steps of:

preparing a substrate having said heating surface formed thereon;

forming a cover film on said heating surface so as to cover at least said heating surface;

forming said ink channel on said substrate; and removing said cover film through said ink channel.

* * * * *

UNITED STATES PATENT AND TRADEMARK OFFICE

CERTIFICATE OF CORRECTION

PATENT NO. : 5,163,177

DATED : November 10, 1992

INVENTOR(S) : Hirokazu KOMURO

It is certified that error appears in the above-identified patent and that said Letters Patent is hereby corrected as shown below:

Title Page:

AT [19] UNITED STATES PATENT:

"Komura" should read --Komuro--.

AT [75] INVENTOR:

"Hirokazu Komura" should read --Hirokazu Komuro--.

COLUMN 3:

Line 37, "abovedescribed" should read --above-described--.

COLUMN 5:

Line 59, "bubble generat-" should read --bubble-generat- --.

COLUMN 7:

Line 37, "a" should read --as--;

Line 46, "wall forming" should read --wall-forming--;

Line 64, "(AL)" should read --(Al)--;

Line 68, "arc" should read --are--.

UNITED STATES PATENT AND TRADEMARK OFFICE

CERTIFICATE OF CORRECTION

PATENT NO. : 5,163,177 Page 2 of 2

DATED : November 10, 1992

INVENTOR(S) : Hirokazu KOMURO

It is certified that error appears in the above-identified patent and that said Letters Patent is hereby corrected as shown below:

COLUMN 8:

Line 53, "abovementioned" should read --above-mentioned--.

COLUMN 9:

Line 27, "include," should read --include--;

Line 29, "electro thermal" should read --electro -thermal--.

COLUMN 10:

Line 29, "forms," should read --forms--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*